United States Patent [19]

Makino et al.

[11] 4,379,004

[45] Apr. 5, 1983

[54] METHOD OF MANUFACTURING AN AMORPHOUS MAGNETIC ALLOY

[75] Inventors: Yoshimi Makino; Masatoshi Hayakawa; Koichi Aso; Satoru Uedaira; Shigeyasu Ito; Kazuhide Hotai, all of Kanagawa, Japan

[73] Assignee: Sony Corporation, Tokyo, Japan

[21] Appl. No.: 161,077

[22] Filed: Jun. 19, 1980

[30] Foreign Application Priority Data

Jun. 27, 1979 [JP] Japan ..... 54-80955

[51] Int. Cl.[3] ..... H01F 1/02

[52] U.S. Cl. ..... 148/108; 148/103

[58] Field of Search ..... 148/103, 108, 121

[56] References Cited

U.S. PATENT DOCUMENTS 4,116,728 9/1978 Becker et al. ..... 148/108

4,236,946 12/1980 Aboaf et al. ..... 148/108

4,249,969 2/1981 DeCristofaro et al. ..... 148/108

*Primary Examiner*—John P. Sheehan

*Attorney, Agent, or Firm*—Hill, Van Santen, Steadman, Chiara & Simpson

[57] ABSTRACT

A method of manufacturing a high permeability amorphous magnetic alloy is disclosed. In the method amorphous magnetic alloy ribbon prepared by quenching a melt of raw material is annealed at an elevated temperature lower than a crystallization temperature of the alloy, in a magnetic field. During the annealing, the alloy ribbon and the direction of the magnetic field are relatively rotated with each other. The method is especially useful to an amorphous magnetic alloy having high saturation magnetic induction where the magnetic Curie temperature of the alloy usually exceeds the crystallization temperature of the alloy.

7 Claims, 16 Drawing Figures

METHOD OF MANUFACTURING AN AMORPHOUS MAGNETIC ALLOY

BACKGROUND OF THE INVENTION

1. Field of the Invention

This invention relates generally to a method of manufacturing an amorphous magnetic alloy, and especially to heat treatment of an amorphous magnetic alloy having high permeability, and high saturation magnetic induction.

2. Description of the Prior Art

In the art, a centrifugal quenching method, single roll quenching method, double roll quenching method and so on, are known methods to prepare amorphous magnetic alloys of an iron system, a cobalt-iron system, a cobalt-iron-nickel system, an iron-nickel system, and so on, which are known as soft magnetic materials. In these methods, a melt of raw material containing metal elements and so-called glass forming elements is quenched to form an amorphous alloy ribbon. In the method, internal stress $\sigma$ is induced in the amorphous ribbon during manufacturing, which results in deteriorated magnetic characteristics by coupling with a magnetostriction constant $\lambda$. Since permeability $\mu$ satisfies a relation $\mu\alpha(1/\lambda\sigma)$, larger internal stress results in a deteriorated permeability $\mu$ and an increased coersive force Hc, both of which are not desirable characteristics for soft magnetic material used as core elements of a magnetic circuit. Among various amorphous magnetic alloys, it is known that iron system amorphous alloys can be improved in permeability by annealing at an elevated temperature, under an application of a magnetic field or without the application of the magnetic field, to release the internal stress.

While, the permeability of a cobalt-iron system alloy can be improved by quenching the core shaped amorphous ribbon from a temperature T which is higher than the magnetic Curie temperature Tc of the alloy and lower than the crystallization temperature Tcry of the alloy ($0.95\times Tc \leqq T < Tcry$).

Recently, it has been necessary to manufacture an amorphous magnetic alloy superior in not only permeability but also saturation magnetic induction Bs, to meet the requirement of high density magnetic recording in which a so-called metal magnetic tape having high coersive force is employed. In this case, the magnetic alloy used as the core of a magnetic transducer head must have a high saturation magnetic induction, for example more than 8000 gauss. In the amorphous magnetic alloy, it is necessary to increase the composition ratio of the transition metal elements such as, iron, cobalt, and nickel to obtain a high saturation magnetic induction. However, as there is a general tendency, the magnetic Curie temperature Tc of the alloy increases and the crystallization temperature Tcry of the alloy decreases upon increase of the transition metal elements. For example, in a Co-Fe-Si-B system amorphous magnetic alloy, when the total amount of Co and Fe is more than 78 atomic % of the alloy, the crystallization temperature Tcry becomes lower than the magnetic Curie temperature Tc. Thus, the above mentioned method of quenching the alloy from the temperature T satisfying the relation $0.95\times Tc \leqq T < Tcry$ can not be applicable to the alloy containing more than 78 atomic % of Co and Fe to increase the saturation magnetic induction.

Especially in Co-Fe system amorphous alloys, the alloys have large induced magnetic anisotropy due to the existence of Co, even the alloys have high saturation magnetic induction, permeability of the alloy is rather low, and the alloy is not practically usable.

OBJECT AND SUMMARY OF THE INVENTION

Accordingly, it is an object of the present invention to provide an improved method of manufacturing an amorphous magnetic alloy.

It is another object of the present invention to provide a method of manufacturing an amorphous magnetic alloy having high permeability.

It is a further object of the present invention to provide a method of manufacturing an amorphous magnetic alloy having high permeability and high saturation magnetic induction.

It is a still further object of the present invention to provide a novel heat treatment for an amorphous magnetic alloy having a magnetic Curie temperature higher than the crystallization temperature.

According to one aspect of the present invention there is provided a method of manufacturing an amorphous magnetic alloy which comprises the steps of preparing an amorphous magnetic alloy ribbon, and keeping said alloy ribbon at an elevated temperature lower than a crystallization temperature of the alloy, wherein the alloy ribbon and a direction of the magnetic field are relatively moved with each other.

The other features, objects, and advantages of the present invention will become apparent from the following description taken in conjunction with the accompanying drawings.

DESCRIPTION OF THE PREFERRED EMBODIMENTS

Figure 1:
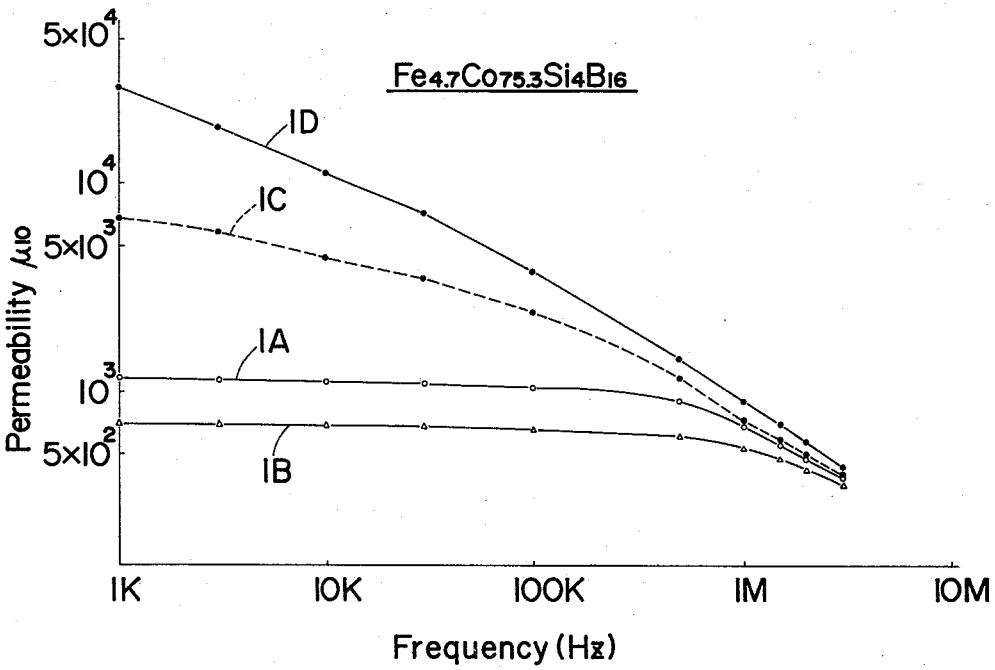
FIGS. 1, 3, and 5 are graphs showing frequency versus permeability characteristics of amorphous alloy samples subjected to various heat treatments.

The present invention will be hereinafter described in detail. In this invention an amorphous magnetic alloy is manufactured by quenching a melt containing metal elements and so-called glass-forming elements by any known method, such as, centrifugal quenching method, single roll quenching method, double roll quenching method, and so on. The amorphous magnetic alloy thus obtained is then annealed at an elevated temperature below a crystallization temperature of the alloy under application of an external magnetic field rotating relative to the amorphous magnetic alloy.

By annealing in the rotating magnetic field, it is possible to greatly increase permeability of the amorphous alloy by eliminating an induced magnetic anisotropy of the amorphous alloy. This method can be applicable to various amorphous magnetic alloys, since the method is not restricted by the relation between the magnetic Curie temperature Tc and the crystallization temperature Tcry of the alloy. As a matter of fact, the method of the present invention is applicable to all of the alloys which respond to magnetic annealing. The present invention is especially effective with an amorphous alloy having high saturation magnetic induction though having low permeability, in which an effective method to improve the permeability has not been known. An example of such an alloy is a Co-Fe-Si-B system amorphous alloy containing more than 78 atomic % transition metal elements. In the present invention, "relative rotation between the amorphous alloy sample and the external magnetic field" means any relative motion of a direction of magnetic field which excludes a formation of summation of magnetic field directed to a specific direction. In other words, relative rotation of the magnetic field to the amorphous alloy samples is effective as far as the magnetic field avoids any arrangement or coodination of atoms with specific order in the amorphous alloy. Accordingly "relative rotation" includes rotation in a plane as shown in later explained example, summation of rotations in different planes, and random switching of the external magnetic field in more than 3 directions. In these cases, the external field may be rotated, the alloy sample may be rotated, and both may be rotated.

Similar to crystalline magnetic material, amorphous magnetic alloys, especially cobalt system amorphous alloys, show an induced magnetic anisotropy. This can be estimated from the fact that an amorphous alloy as prepared having a composition of $Fe_{4.7}Co_{75.3}Si_4B_{16}$ (in atomic ratio) which has essentially zero magnetostriction constant shows low permeability ($\mu \approx 1000$). The existence of the induced magnetic anisotropy suggests that a short range order of atoms or pair order of atoms magnetically induced even in such an amorphous alloy though they are very small. According to the previously explained method of quenching the amorphous alloy from a temperature higher than magnetic Curie temperature, the above mentioned order or coordination of atoms are disturbed to a disordered state by heating the alloy higher than the magnetic Curie temperature, then the disordered state is frozen by quenching.

In the present invention, the order or the coordination of atoms are disturbed to a disordered state by heat treatment in an external magnetic field rotating relative to the alloy sample. For example, the disordered state can be obtained by moving the magnetic field faster than the thermal diffusion velosity of the atoms, at an elevated temperature. Then the disordered state is frozen by cooling the alloy in the magnetic field which is continuously rotating relative to the alloy.

In the present invention it is preferable to rotate the external magnetic field relative to the alloy so fast that the atoms of the alloy by thermal diffusion cannot catch up to the movement of the magnetic field. Since the direction of the external magnetic field is always changing, the ordering of the atoms, or the coodination of the atoms is difficult to achieve, and the alloy is nearly in a disordered state even if the ordering or the coordination occurs. Therefore, the disordered state can be frozen by cooling the alloy in the magnetic field rotating relative to the alloy, (or quenching). The lower limit of the rotation speed of the external magnetic field depends on composition of the alloy, the strength of the magnetic field, and the annealing temperature. The annealing temperature of the present invention must be lower than the crystallization temperature of the amorphous alloy. However, it is sufficient so far as it is higher than a temperature that the atoms of the alloy can diffuse. The temperature depends on the composition of the alloy, the strength of external magnetic field, and the annealing time. It is preferable that the annealing temperature is higher than 200° C., though, there is a tendency that the higher temperature is more effective and shortens the annealing time.

Further it is preferable to select the external magnetic field sufficiently strong to magnetically saturate the alloy at the annealing temperature.

Comparison Example 1

Fe, Co, Si and B were weighted to form a composition of $Fe_{4.7}Co_{75.3}Si_4B_{16}$ (in atomic ratio) and melted by an induction heating to form a mother alloy. An amorphous magnetic alloy ribbon was obtained by quenching a melt of the mother alloy using an apparatus proposed in our copending U.S. patent application Ser. No. 936,102, filed Aug. 23, 1978, now issued as U.S. Pat. No. 4,212,344 to Uedaira et al.

Figure 2A:
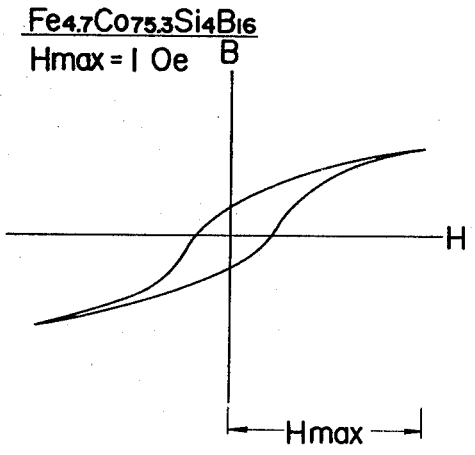
FIGS. 2A to 2D, 4A to 4C and 6A to 6E are B–H hysteresis loop of the amorphous alloy samples subjected to various heat treatments shown by FIGS. 1, 3, and 5 respectively; and, FIG. 7 is a B–H hysteresis loop of ring-shaped amorphous alloy subjected to a magnetic annealing.

The amorphous alloy had a saturation magnetic induction Bs of 11000 gauss, a crystallization temperature of 420° C. and a Curie temperature higher than the crystallization temperature. The obtained alloy ribbon was ascertained to be amorphous by X-ray diffraction. A ring shaped sample having 10 mm or outer diameter and 6 mm of inner diameter was cut out from the alloy ribbon by ultra sonic punching. Permeability and A, C, B–H, hysteresis loop of the cut-out sample as prepared without applying any heat treatment were measured. The permeability is shown by line 1A in FIG. 1 and B–H hysteresis loop is shown in FIG. 2A. The permeability was measured by the use of a Maxwell bridge under the magnetic field of 10 m Oe.

Comparison Example 2

Figure 2B:
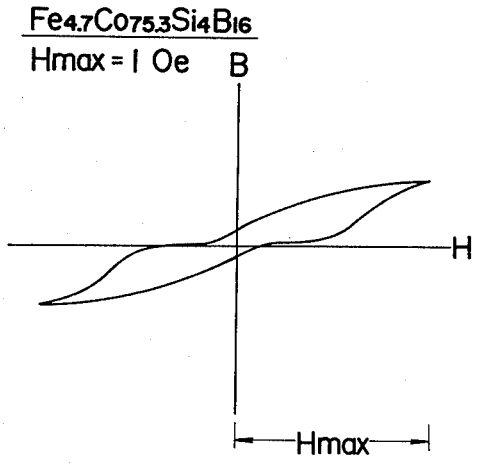

An amorphous ribbon having the same composition as example 1 was prepared. A disk-shaped sample having a diameter of 12 mm was cut out from the ribbon. The sample was annealed at 400° C. for 5 minutes without applying an external magnetic field, and then quenched. Then, a ring shaped sample having the same dimension as the sample of the comparison example 1 was cut out from thus heat treated sample. The ring shaped sample was subjected to measurement of permeability and A, C, B–H hysteresis loop. Obtained results are shown by line 1B in FIG. 1 and in FIG. 2B respectively.

Example 1

Figure 2C:
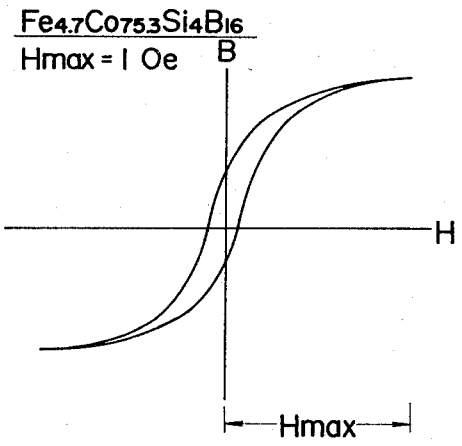

An amorphous ribbon having the same composition as the comparison example 1 was prepared. A disk shaped sample having a diameter of 12 mm was cut out from the ribbon. The disk shaped sample was held between holder plates made of copper and annealed at 300° C., which was lower than the crystallization temperature of the alloy, for 60 minutes in a D. C. magnetic field of 5 KOe, while the sample was rotated by a motor at 20 rotations per second. The sample was cooled while rotating continuously in the magnetic field. During rotation, the sample was so set that the major surface of the alloy sample and the direction of the magnetic field was parallel. After the heat treatment, a ring-shaped sample having the same dimension as the comparison example 2 was cut out for measurement of characteristics. The permeability of the sample is shown by line 1C in FIG. 1 and B–H hysteresis loop is shown in FIG. 2C respectively. The temperature of the sample during the annealing was measured by a thermocouple provided adjacent to the rotating sample. Considering temperature gradient in the furnace and frictional heat due to the friction between the sample and the thermocouple, the exact temperature of the sample was estimated about 40° C. lower than the value derived from the thermocouple.

Example 2

Figure 2D:
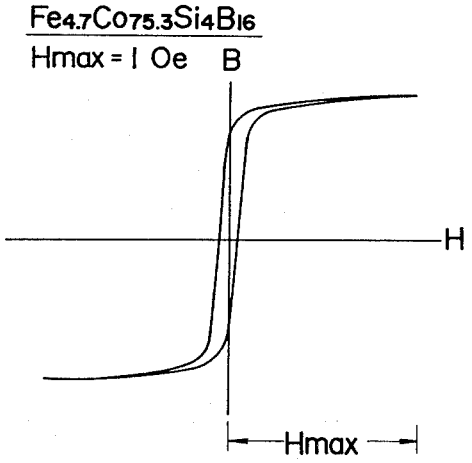

Similar to example 1, the alloy sample was annealed in the D. C. magnetic field of 5 KOe at 400° C. which was lower than the crystallization temperature of the alloy for 40 minutes. During the annealing, the sample was rotated by the motor at 20 rotations per second. The thus heat-treated sample was subjected to the measurement of the above characteristics. The permeability is shown by line 1D in FIG. 1 and A, C, B–H hysteresis loop is shown in FIG. 2D.

Comparison Example 3

Figure 3:
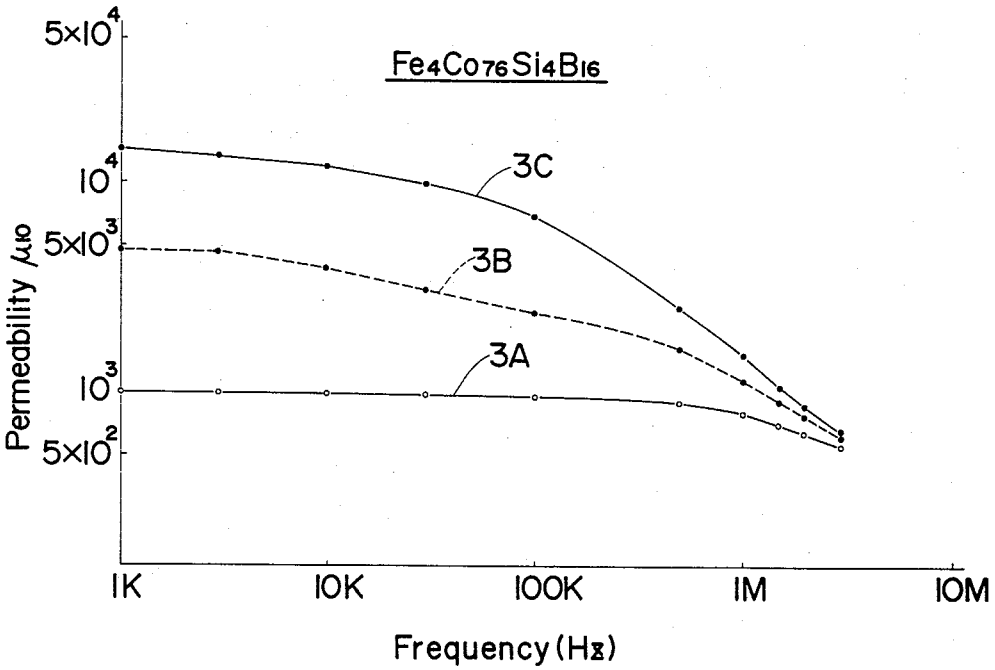
Figure 4A:
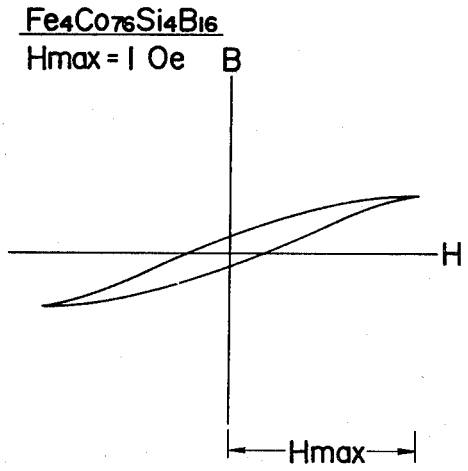

An amorphous magnetic alloy sample having a composition of $Fe_4 Co_{76} Si_4 B_{16}$ (in atomic ratio) was prepared. The alloy had a saturation magnetic induction of 10500 gauss, a crystallization temperature of about 420° C., and a Curie temperature higher than the crystallization temperature. A ring shaped sample having the same dimension was cut out, and this sample as prepared was subjected to the measurement similar to the comparison example 1. The permeability of the sample is shown by line 3A in FIG. 3 and B–H hysteresis loop is shown in FIG. 4A.

Examples 3 and 4

Figure 4B:
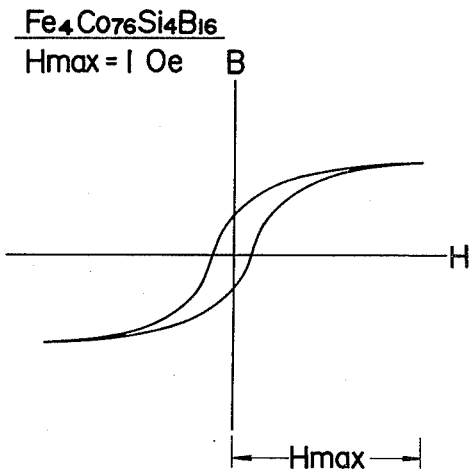
Figure 4C:
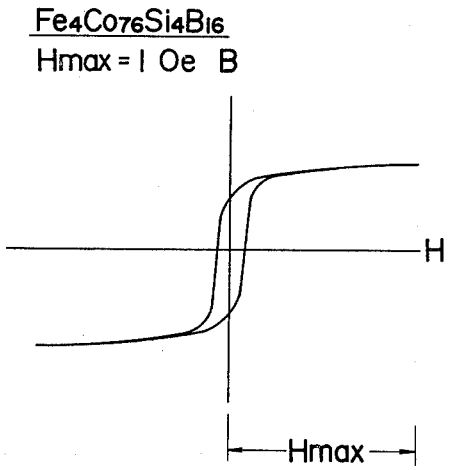

From the amorphous ribbon having a composition of $Fe_4 Co_{76} Si_4 B_{16}$ (in atomic ratio), disc shaped samples having the same dimension as the example 2 were prepared. Each sample was subjected to a heat treatment in the magnetic field of examples 1 and 2 respectively. The permeability of the samples annealed similar to examples 1 and 2 are shown by lines 3B and 3C respectively, and the B–H hysteresis loops are shown in FIGS. 4B and 4C respectively.

Comparison Examples 4–5, Examples 5–7

Figure 5:
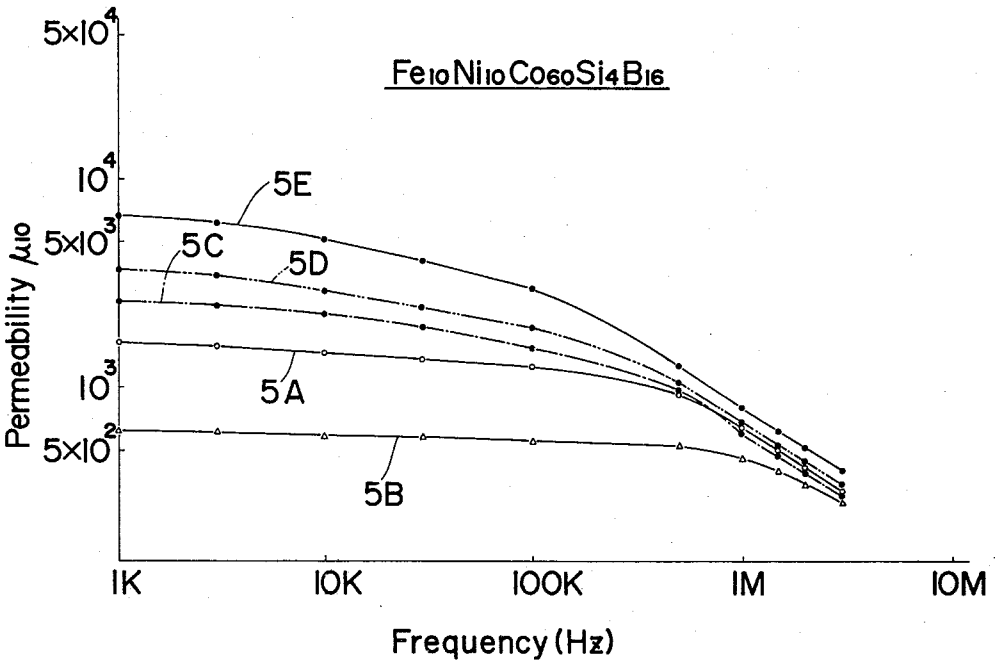
Figure 6A:
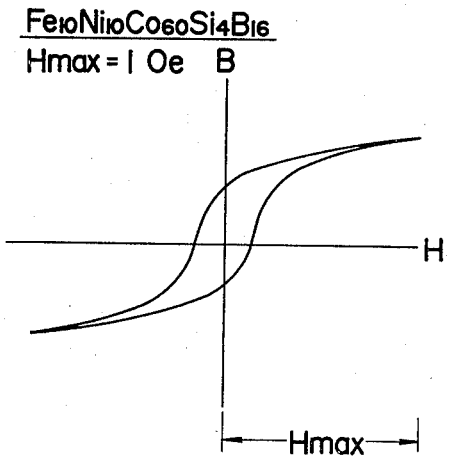

Amorphous magnetic alloy ribbons having a composition of $Fe_{10} Ni_{10} Co_{60} Si_4 B_{16}$ (in atomic ratio) were prepared. From the amorphous ribbon, an alloy sample similar to the comparison example 1 was formed and the sample as prepared was subjected to the measurements of comparison example 1. The permeability is shown by line 5A in FIG. 5 and the B–H hysteresis loop is shown in FIG. 6A.

Figure 6B:
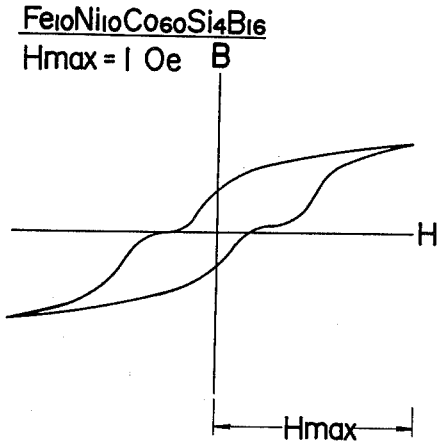
Figure 6C:
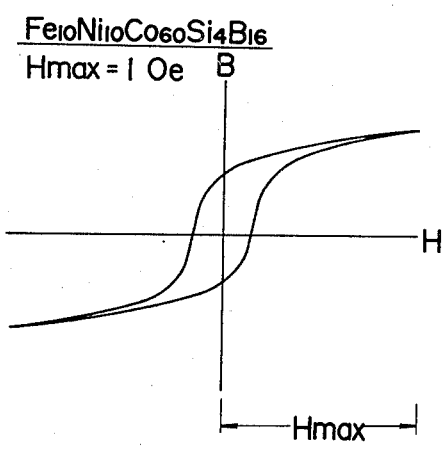
Figure 6D:
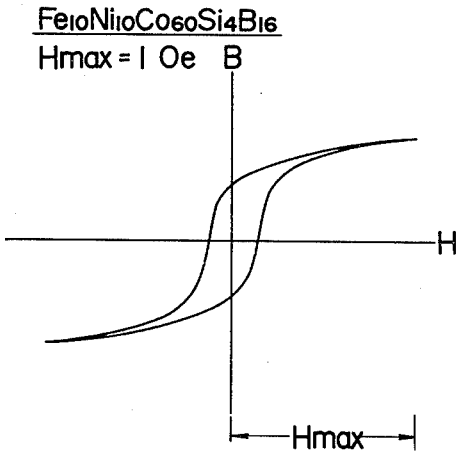
Figure 6E:
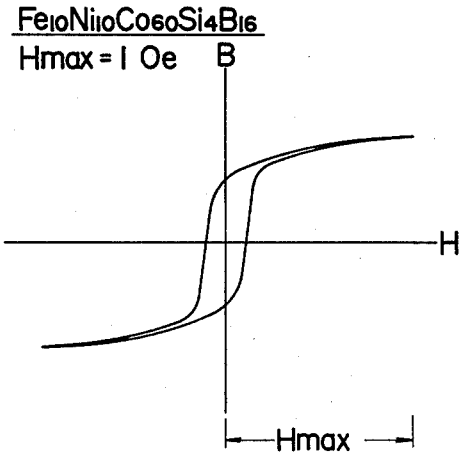

From the amorphous ribbon, a disc shaped sample was cut out, subjected to the heat-treatment of comparison example 2. Permeability and the B–H hysteresis loop were measured and the results are shown by line 5B in FIG. 5 and in FIG. 6B respectively. From the amorphous alloy ribbons, disk-shaped samples having the same dimension as example 1 were cut out. The samples were subjected to heat treatment in a rotating magnetic field of 5 KOe relative to the samples similar to the example 1, at 400° C. for 5 minutes (Example 5), at 400° C. for 15 minutes (Example 6), and at 400° C. for 40 minutes (Example 7). Permeability of the examples 5 to 7 are shown by lines 5C to 5E in FIG. 5 respectively. B–H loops of examples 5 to 7 are shown in FIGS. 6C to 6E respectively. As apparent from comparison examples 1, 3 and 4, the alloy samples as prepared did not have high permeability (for example, the sample of comparison example 4 had permeability of only $1.5\times10^3$ at 1 KHz).

The alloy samples of comparison examples 2 and 5, which were annealed without applying a magnetic field, showed further deteriorated permeability (for example $7\times10^2$ at 1 KHz in case of comparison example 2). The measured results suggest that the induced magnetic anisotropy is increased by the annealing. As apparent from the results of the examples 1 to 7, according to the present invention, permeability of the amorphous alloy is greatly increased. Further, it is known from the results that the higher the annealing temperature and the longer the annealing time, the more improved the permeability. It is also known from the hysteresis loops measured on the samples applied with heat-treatment of the present invention, saturation magnetic induction is increased.

Figure 7:
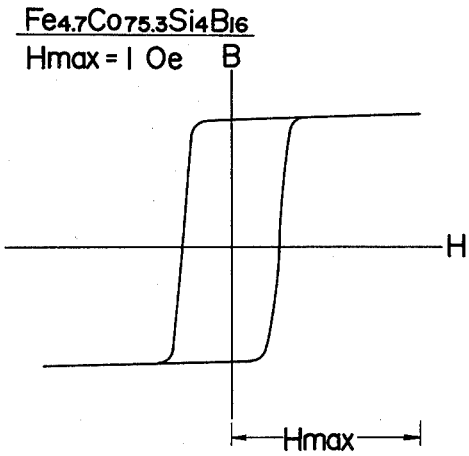

Amorphous magnetic alloys employed in the Examples respond to magnetic annealing. This was ascertained by a rectangular hysteresis loop shown in FIG. 7 when the ring shaped amorphous alloy samples were cooled from an elevated temperature, while applying an magnetic field along the ring.

We claim as our invention:

1. A method of manufacturing an amorphous magnetic alloy comprising the steps of:

(a) preparing an amorphous magnetic alloy ribbon; and (b) annealing said amorphous alloy ribbon at an elevated temperature, which is lower than the crystallization temperature Tcry of said alloy in a magnetic field, wherein said amorphous magnetic alloy ribbon and the direction of said magnetic field are continuously rotated with respect to one another, the relative rotation being at a velocity which is faster than the thermal diffusion velocity of the atoms forming the amorphous alloy at said elevated temperature.

2. A method according to claim 1, wherein said said temperature is higher than 200° C.

3. A method according to claim 1, wherein said ribbon is rotated in the magnetic field.

4. A method according to claim 1, wherein said direction of said magnetic field is rotated around said ribbon.

5. A method of manufacturing an amorphous magnetic alloy having high permeability and high saturation magnetic induction comprising the steps of:

(a) preparing an amorphous magnetic ribbon containing transition metal elements and glass-forming elements, and having a crystallization temperature Tcry lower than the Curie temperature of said alloy; and (b) annealing said alloy ribbon in an external magnetic field at an elevated temperature which is lower than said crystallization temperature Tcry of the alloy, but higher than 200° C., and wherein said amorphous ribbon and said magnetic field are continuously moved rotationally relative to one another, said relative movement being faster than the thermal diffusion of the atoms composing the amorphous alloy, whereby the formation of induced magnetic anisotropy is prevented.

6. A method according to claim 5 further comprises the step of cooling said amorphous ribbon in said magnetic field.

7. A method according to claim 5 further comprises the step of quenching said amorphous ribbon from said annealing temperature.

* * * * *